US009782971B2

(12) United States Patent
Vernon et al.

(10) Patent No.: US 9,782,971 B2
(45) Date of Patent: Oct. 10, 2017

(54) CARTRIDGE SERVICING CASES FOR FLUID JET CARTRIDGE

(71) Applicant: The Procter & Gamble Company, Cincinnati, OH (US)

(72) Inventors: Paul John Edward Vernon, West Chester, OH (US); Thomas Elliot Rabe, Baltimore, OH (US); Grant Edward Anders Striemer, Fairfield Township, OH (US); Janette Villalobos Lingoes, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/960,949

(22) Filed: Dec. 7, 2015

(65) Prior Publication Data

US 2017/0157933 A1 Jun. 8, 2017

(51) Int. Cl.
*B41J 2/165* (2006.01)
*B41J 3/36* (2006.01)

(52) U.S. Cl.
CPC ..... *B41J 2/16535* (2013.01); *B41J 3/36* (2013.01)

(58) Field of Classification Search
CPC ..... B41J 29/38; B41J 3/36; B41J 2/16535; H04L 67/12
See application file for complete search history.

(56) References Cited

U.S. PATENT DOCUMENTS

| | | | | |
|---|---|---|---|---|
| 6,199,973 | B1 | 3/2001 | Bartolome et al. | |
| 6,312,124 | B1 | 11/2001 | Esormeaux | |
| 7,648,364 | B2 | 1/2010 | Dauga | |
| 7,731,326 | B2 | 6/2010 | Perez et al. | |
| 7,890,152 | B2 | 2/2011 | Edgar | |
| 8,007,062 | B2 | 8/2011 | Edgar | |
| 8,027,505 | B2 | 9/2011 | Edgar | |
| 8,184,901 | B2 | 5/2012 | Edgar | |
| 8,231,292 | B2 | 7/2012 | Rabe | |
| 8,695,610 | B2 | 4/2014 | Samain | |
| D750,225 | S | 2/2016 | Rabe | |
| D750,772 | S | 3/2016 | Rabe | |
| 2003/0060810 | A1 | 3/2003 | Syrowicz | |
| 2004/0130587 | A1* | 7/2004 | Yakura | B41J 2/16585 347/30 |

(Continued)

FOREIGN PATENT DOCUMENTS

| | | | |
|---|---|---|---|
| FR | 2933585 | B1 | 10/2011 |
| JP | 2006297691 | A | 11/2006 |

(Continued)

*Primary Examiner* — Justin Seo
(74) *Attorney, Agent, or Firm* — Amanda Herman; Steven Robert Chuey

(57) ABSTRACT

A cartridge servicing case for servicing a fluid jet cartridge carrying a composition includes a case body having a pocket that is sized to receive the fluid jet cartridge. A moveable cartridge servicing member is moveable relative to the case body. The moveable cartridge servicing member includes at least one of a wiping element and a capping element carried by the moveable cartridge servicing member. The pocket is arranged and configured to expose nozzles of the fluid jet cartridge received by the pocket to the moveable cartridge servicing member for a servicing operation using the at least one of the wiping element and capping element.

20 Claims, 8 Drawing Sheets

(56) References Cited

U.S. PATENT DOCUMENTS

| | | | |
|---|---|---|---|
| 2004/0181196 | A1 | 9/2004 | Pickup et al. |
| 2006/0164460 | A1* | 7/2006 | Uwagaki ..... B41J 2/16544 347/32 |
| 2007/0076045 | A1 | 4/2007 | James et al. |
| 2008/0194971 | A1 | 8/2008 | Edgar |
| 2008/0204503 | A1 | 8/2008 | Studer et al. |
| 2009/0025747 | A1 | 1/2009 | Edgar |
| 2010/0224205 | A1 | 9/2010 | Mitra |
| 2010/0224209 | A1 | 9/2010 | Rabe |
| 2010/0224210 | A1 | 9/2010 | Rabe |
| 2010/0224211 | A1 | 9/2010 | Rabe |
| 2011/0129283 | A1 | 6/2011 | Samain |
| 2011/0155161 | A1 | 6/2011 | Samain |
| 2011/0159463 | A1 | 6/2011 | Samain |
| 2011/0162673 | A1 | 7/2011 | Samain |
| 2015/0360015 | A1 | 12/2015 | Rabe |
| 2015/0360016 | A1 | 12/2015 | Rabe |
| 2015/0360017 | A1 | 12/2015 | Rabe |
| 2015/0360018 | A1 | 12/2015 | Baker |
| 2015/0360019 | A1 | 12/2015 | Clancy |
| 2015/0360020 | A1 | 12/2015 | Wu |
| 2016/0022006 | A1 | 1/2016 | Rabe |
| 2016/0022008 | A1 | 1/2016 | Rabe |
| 2016/0022009 | A1 | 1/2016 | Rabe |
| 2016/0022010 | A1 | 1/2016 | Rabe |
| 2016/0022011 | A1 | 1/2016 | Rabe |
| 2016/0022972 | A1 | 1/2016 | Rabe |

FOREIGN PATENT DOCUMENTS

| | | |
|---|---|---|
| WO | WO2009036876 | 3/2009 |
| WO | WO2010004531 | 1/2010 |

* cited by examiner

CARTRIDGE SERVICING CASES FOR FLUID JET CARTRIDGE

FIELD

The present application relates to cartridge servicing cases and, more particularly, to cartridge servicing cases for cleaning and storing a fluid jet cartridge.

BACKGROUND

Inkjet devices, piezo and thermal, are common for both personal and industrial printing purposes. Most commonly, such devices are found in consumer homes as a means to create high quality prints and photos. In consumer applications there is a high need for reliable performance with minimal effort from the consumer. Because of this all existing consumer printing devices contain sophisticated processes for maintaining a high print quality. It is common for consumer inkjet printing devices to contain thousands of individual nozzles with each nozzle as small as 5-20 microns. Additionally, most inks in such devices are volatile and are prone to drying out quickly when exposed to air. Due to the small and numerous nozzles and fast dry times, it is difficult to keep all nozzles working properly over the course of thousands of printed pages and potentially long periods of time between prints. Due to these requirements much effort has been taken by printer manufacturers to devise mechanisms that keep the printing nozzles performing well. Most consumers have no knowledge of all of the servicing that occurs to ensure good print quality as it occurs automatically.

While servicing nozzles of a stationary inkjet printing device is known, there has been little need to consider how to automatically service inkjet nozzles for a handheld printing device. Handheld inkjet printing devices are uncommon and usually used for industrial tasks like labeling boxes during manufacturing. In such cases the servicing needs of nozzles is performed manually. These handheld printers require removal of the inkjet cartridge after each use and manually wiping and capping the printhead. For such industrial applications this may be acceptable. However, there has not been the need to create an automated servicing solution for handheld printing devices.

SUMMARY

In an embodiment, a cartridge servicing case for servicing a fluid jet cartridge carrying a composition includes a case body having a pocket that is sized to receive the fluid jet cartridge. A moveable cartridge servicing member is moveable relative to the case body. The moveable cartridge servicing member includes at least one of a wiping element and a capping element carried by the moveable cartridge servicing member. The pocket is arranged and configured to expose nozzles of the fluid jet cartridge received by the pocket to the moveable cartridge servicing member for a servicing operation using the at least one of the wiping element and capping element.

In another embodiment, a cartridge servicing case for servicing a fluid jet cartridge carrying a composition includes a case body having a pocket that is sized to receive the fluid jet cartridge. A moveable cartridge servicing member is moveable relative to the case body. The moveable cartridge servicing member includes at least one of a wiping element and a capping element carried by the moveable cartridge servicing member. The moveable cartridge servicing member has an open configuration that allows for positioning of the cartridge in the pocket to expose nozzles of the fluid jet cartridge to the moveable cartridge servicing member and a closed configuration that prevents removal of the fluid jet cartridge from the pocket.

In another embodiment, a method of servicing a fluid jet cartridge carrying a composition using a cartridge servicing case is provided. The method includes placing a fluid jet cartridge in a pocket of a case body of the cartridge servicing case that is sized to receive the fluid jet cartridge. A moveable cartridge servicing member is moved from an open configuration to a closed configuration. Nozzles of the fluid jet cartridge exposed to the moveable cartridge servicing member are wiped with a wiping element carried by the moveable cartridge servicing member as the moveable cartridge servicing member moves from the open configuration to the closed configuration.

BRIEF DESCRIPTION OF THE DRAWINGS

While the specification concludes with claims particularly pointing out and distinctly claiming the present invention, it is believed the same will be better understood from the following description taken in conjunction with the accompanying drawing in which:

DETAILED DESCRIPTION

Embodiments described herein may be understood more readily by reference to the following detailed description. It is to be understood that the scope of the claims is not limited to the specific compositions, methods, conditions, devices, or parameters described herein, and that the terminology used herein is not intended to be limiting. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values form another embodiment. All ranges are inclusive and combinable.

The present disclosure relates generally to cartridge servicing cases for cleaning and storing a fluid jet cartridge carrying a composition for use in handheld devices. The cartridge servicing cases are separate from the handheld devices and are self-contained devices that are capable of cleaning nozzles of the fluid jet cartridges and storing the fluid jet cartridges, for example, by capping the nozzles. The cartridge servicing cases may include a case body that receives the fluid jet cartridge within a pocket and a moveable cartridge servicing member that moves relative to the case body. The moveable cartridge servicing member may include one or both of a wiping element and a capping element that can be used to clean the nozzles of the fluid jet cartridge and cap the nozzles for storage.

Figure 1:
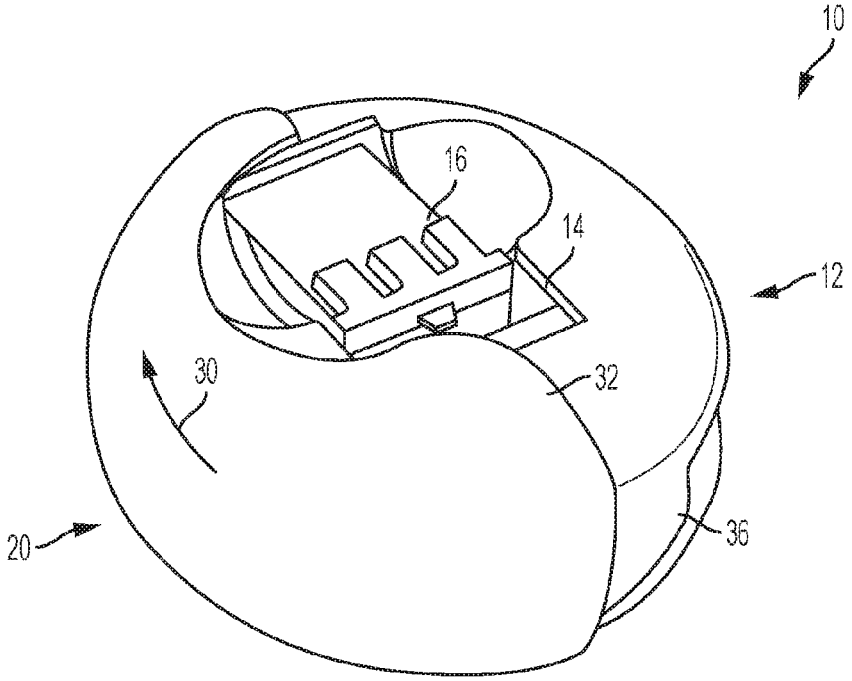
FIG. 1 illustrates a top, perspective view of a cartridge servicing case in an unlocked configuration according to one or more embodiments described herein.
Figure 2:
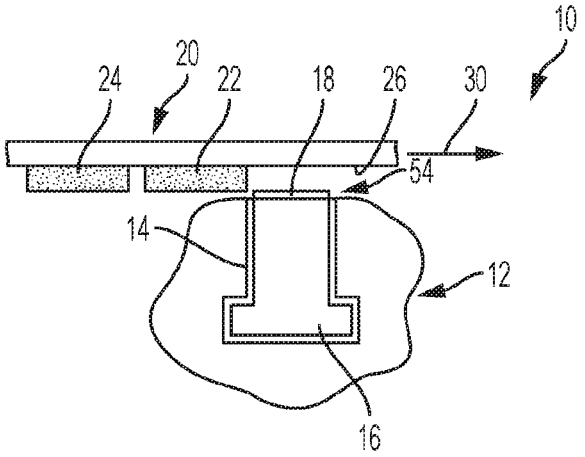
FIG. 2 is a diagrammatic illustration of the cartridge servicing case of FIG. 1 illustrating operation according to one or more embodiments described herein.

Referring to FIGS. 1 and 2, an exemplary cartridge servicing case 10 includes a case body 12 having a pocket 14 that is sized and arranged to receive a fluid jet cartridge 16 therein. The pocket 14 may be shaped to receive the fluid jet cartridge 16 such that an array of nozzles 18 (FIG. 2) is exposed to a moveable cartridge servicing member 20. In some embodiments, the pocket 14 may have alignment features to facilitate a desired orientation of the fluid jet cartridge 16 in the pocket 14. The moveable cartridge servicing member 20 may be moveably attached to the case body 12 and includes a wiping element 22 and a capping element 24 (FIG. 2). The wiping element 22 and the capping element 24 may be located on an interior face 26 of the moveable cartridge servicing member 20, facing the array of nozzles 18. The interior face 26 of the moveable cartridge servicing member 20 may have limited exposure to the environment (e.g., may be located within the cartridge servicing case 10 to limit exposure to dust, sun and other environmental elements.

Figure 4:
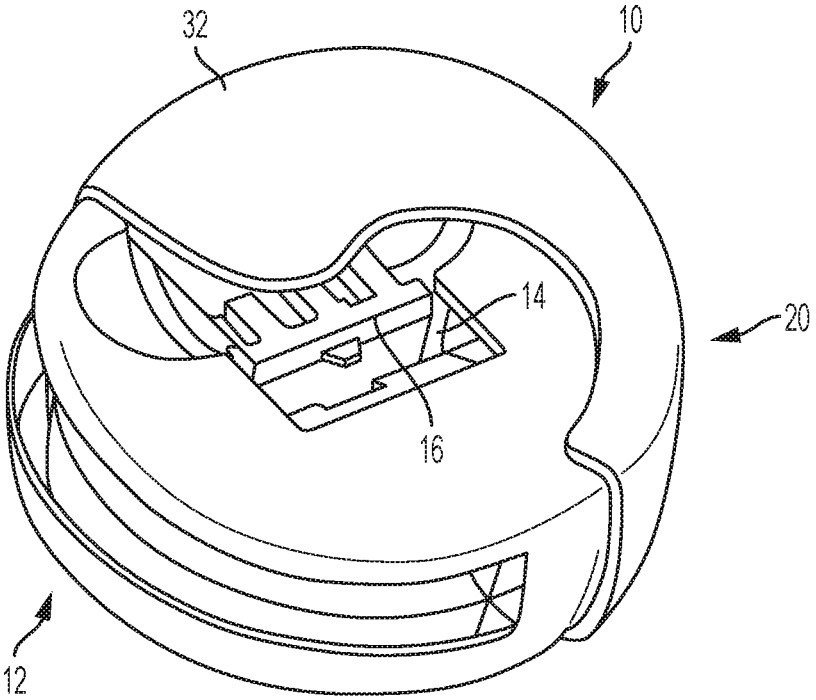
FIG. 4 illustrates a top, perspective view of the cartridge servicing case of FIG. 1 in a locked configuration according to one or more embodiments described herein.

Represented by arrow 30, a force may be applied to the moveable cartridge servicing member 20 to move the moveable cartridge servicing member 20 to initiate a servicing operation. In the illustrated example, the force 30 may be applied to move (e.g., rotate) the moveable cartridge servicing member 20 from an unlocked open configuration (FIG. 1) to a locked clean configuration, which is shown by FIG. 4. In the unlocked open configuration, the cartridge 16 can be placed within the pocket 14 and readily removed from the pocket 14. In the locked clean configuration, the moveable cartridge servicing member 20 can include an access control portion 32 that extends over or overhangs the pocket 14 to inhibit removal of the cartridge 16 from the pocket 14. The access control portion 32 can also maintain the cartridge 16 within the pocket 14 in a capped configuration, as will be described in greater detail below.

Figure 3:
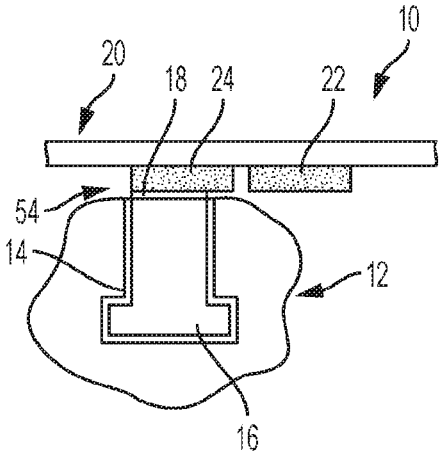
FIG. 3 is a diagrammatic illustration of the cartridge servicing case of FIG. 1 in a capped configuration according to one or more embodiments described herein.

Referring again to FIG. 2 and also FIG. 3, the cartridge servicing case 10 includes the case body 12 and moveable cartridge servicing member that is rotatably received by the case body 12 (e.g., in a tongue and groove like slidable connection 34; see FIG. 1). The case body 12 may be multi-part or may be of unitary construction with the pocket 14 formed therein. The moveable cartridge servicing member 20 is rotatable or otherwise moveable relative to the case body 12 about a periphery 36 of the case body 12 (FIG. 1). The case body 12 may be configured to be held in a user's hand substantially stationary while the moveable cartridge servicing member 20 rotates. To this end, either one or both of the case body and the moveable cartridge servicing member 20 may have graspable features that can be more readily grasped by the user.

The moveable cartridge servicing member 20 includes the wiping element 22 and the capping element 24. While the wiping element 22 and capping element 24 are illustrated in a particular arrangement positioned along the periphery 36 of the case body 12, other arrangements are possible depending, for example, on the composition type of the fluid jet cartridge, case body shape and desired end use. It should also be noted that while both of the wiping element 22 and capping element 24 are each shown, only one of the wiping element 22 and capping element 24 may be provided. Further, multiple ones of the wiping element 22 and capping element 24 may be included. Fluid (e.g., skin care composition or other composition) can collect around the nozzles 18 of the fluid jet cartridge 16 during normal usage of the fluid jet cartridge 16. In some instances, the fluid may dry around the nozzles 18, which may create clogging issues and therefore reduced effectiveness of the nozzles 18. Further, other areas of the fluid jet cartridge 16 may collect fluid and other contaminates. To this end, the fluid jet cartridge 16 can be serviced during a servicing operation by wiping the nozzles 18 using the wiping element 22. Thickness of the wiping element 22 can be selected to come into contact with the nozzles 18.

The wiping element 22 may be formed using any suitable material or combination of materials. Suitable materials include dry and/or pre-moistened materials, such as woven, non-woven, plastic, elastomer, foam, or some other material or combinations of materials.

Figure 5:
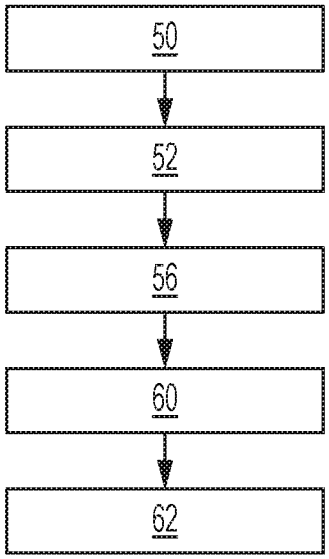
FIG. 5 illustrates a method of operating the cartridge servicing case of FIG. 1 according to one or more embodiments described herein.

Referring to FIG. 5, operation of the cartridge servicing case 10 will be described. Initially, the moveable cartridge servicing member 20 may be moved from the locked clean configuration (FIG. 1) to the unlocked open configuration (FIG. 3) at step 50. Moving the moveable cartridge servicing member 20 to the unlocked open configuration exposes the pocket 14, which can allow for placement of a fluid jet cartridge 16 within the pocket 14 at step 52. In some embodiments, the pocket 14 and fluid jet cartridge 16 may be shaped to cooperate and allow placement of the fluid jet cartridge 16 within the pocket 14 in only one or certain predetermined orientations that expose the nozzles 18 through an opening 54 (FIGS. 2 and 3) in the case body 12 to the wiping element 22 and the capping element 24 (FIG. 2). At step 56, holding the case body 12 in one hand, the user may rotate the moveable cartridge servicing member 20 relative to the case body 12 toward the locked clean configuration. Moving the moveable cartridge servicing member 20 relative to the case body 12 (and the fluid jet cartridge 16) moves the wiping element 22 by the nozzles 18, wiping the nozzles 18 in the process. In some embodiments, the moveable cartridge servicing member 20 may be moved repeatedly to the locked clean configuration. Once in the locked clean configuration, the capping element 24 can align with the nozzles 18 thereby covering and capping the nozzles 18 at step 60. To this end, the capping element 24 may be formed of any suitable material for maintaining humidification of the nozzles 18 during non-use, such as closed and/or open celled foams, plastics, elastomers or combinations of materials. At step 62, to access the fluid jet cartridge 16, the user may move the moveable cartridge servicing member 20 to the unlocked open configuration, which allows the fluid jet cartridge 16 to be removed from the pocket 14. Movement of the moveable cartridge servicing member 20 uncaps the nozzles 18 and also can provide another wiping procedure using the wiping element 22.

Figure 6:
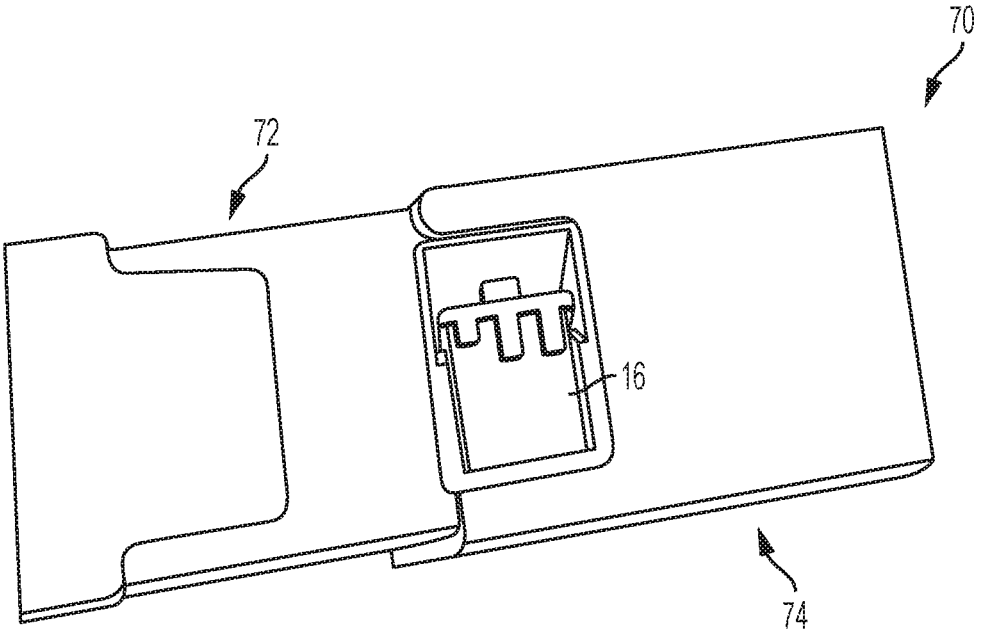
FIG. 6 illustrates a top view of another cartridge servicing case in an unlocked configuration according to one or more embodiments described herein.
Figure 7:
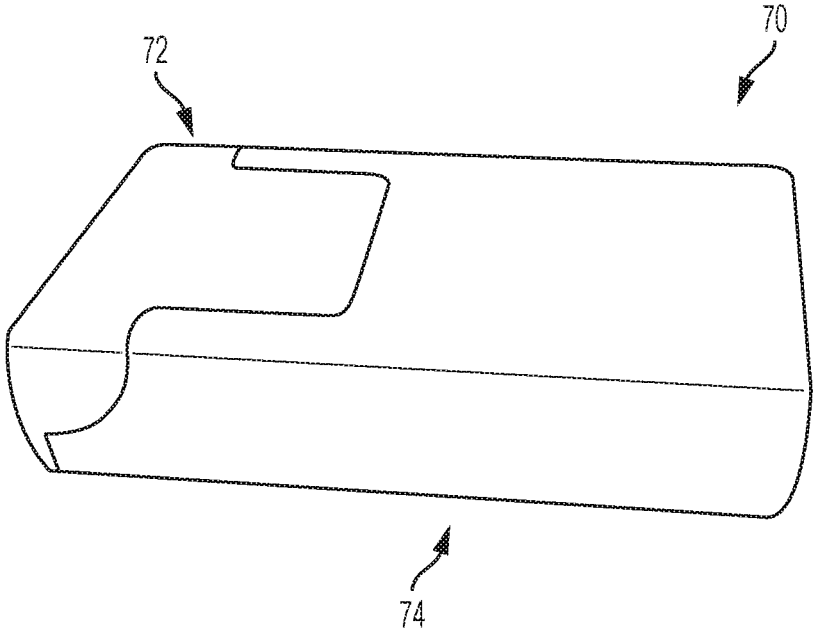
FIG. 7 illustrates the cartridge servicing case of FIG. 6 in a locked configuration.

While a disk-shaped cartridge servicing case 10 is illustrated above, other arrangements are possible. Referring to FIGS. 6 and 7, another cartridge servicing case 70 includes a moveable cartridge servicing member 72 that can move relative to a case body 74. In this example, the moveable cartridge servicing member 72 moves linearly between an unlocked open configuration (FIG. 6) and a locked clean configuration (FIG. 7) to wipe and cap nozzles of fluid jet cartridge 16 using wiping and capping elements like those described above with reference to FIGS. 2 and 3.

Figure 8:
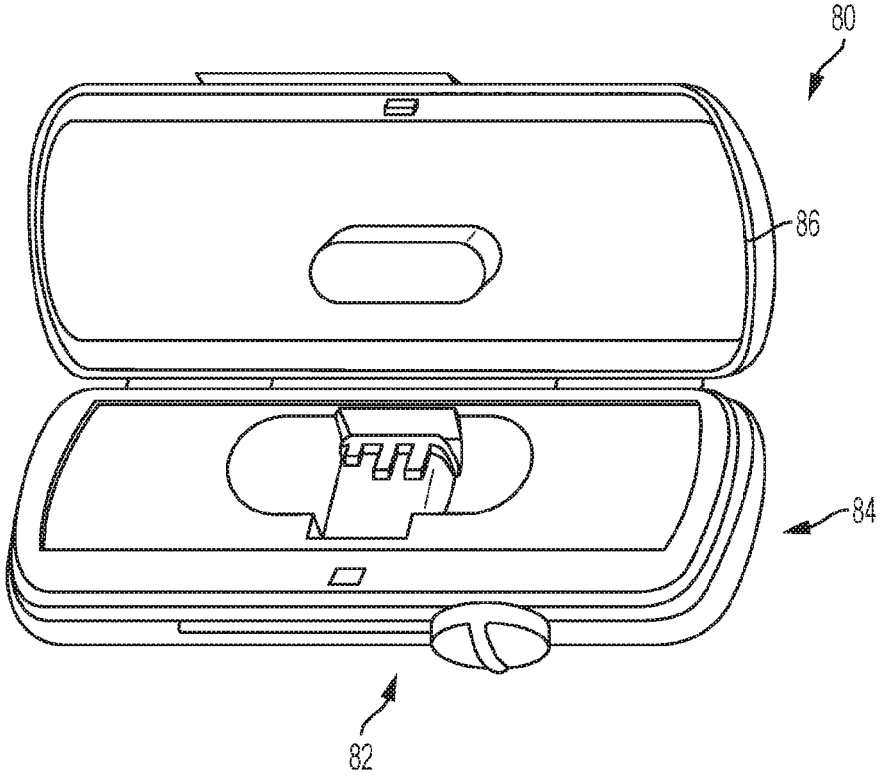
FIG. 8 illustrates a top, perspective view of another cartridge servicing case in an unlocked configuration according to one or more embodiments described herein.
Figure 9:
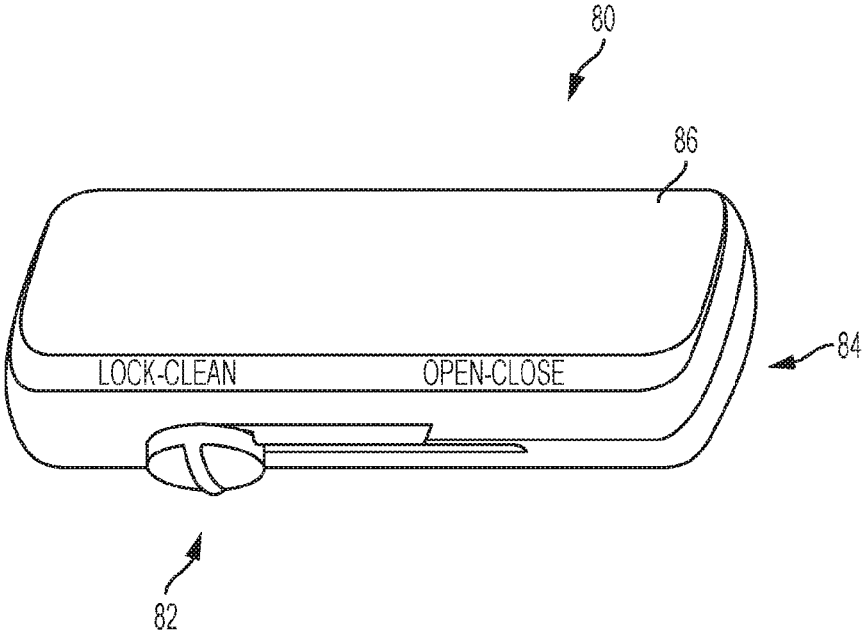
FIG. 9 illustrates the cartridge servicing case of FIG. 8 in a locked configuration.

Referring now to FIGS. 8 and 9, another embodiment of a cartridge servicing case 80 includes a moveable cartridge servicing member 82 that can move relative to a case body 84. In this embodiment, the moveable cartridge servicing member 82 moves linearly between an unlocked configuration (FIG. 8) and a locked clean configuration (FIG. 9). A door 86 may be hingedly attached to the case body 84 that can be moved between open and closed configurations. The moveable cartridge servicing member 82 can be moved from the unlocked open configuration to the locked configuration to wipe and cap nozzles of fluid jet cartridge 16 using wiping and capping elements like those described above with reference to FIGS. 2 and 3 and also to lock the door 86 in its closed configuration.

Figure 10:
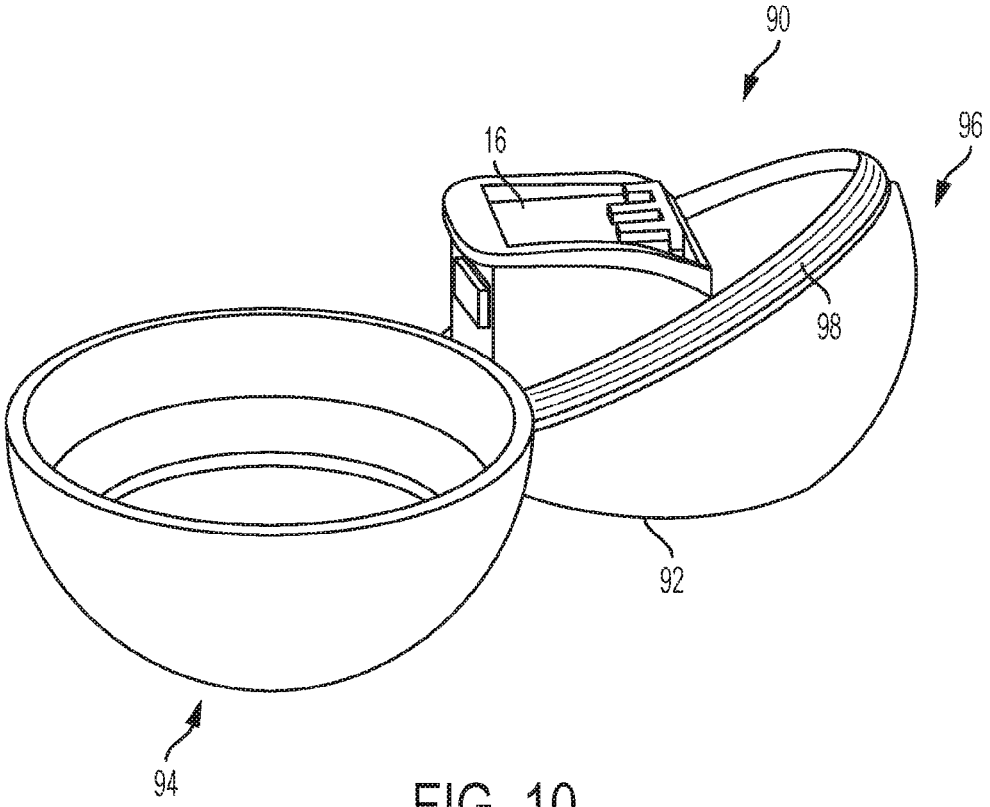
FIG. 10 illustrates a perspective view of another cartridge servicing case in an unlocked configuration according to one or more embodiments described herein.
Figure 11:
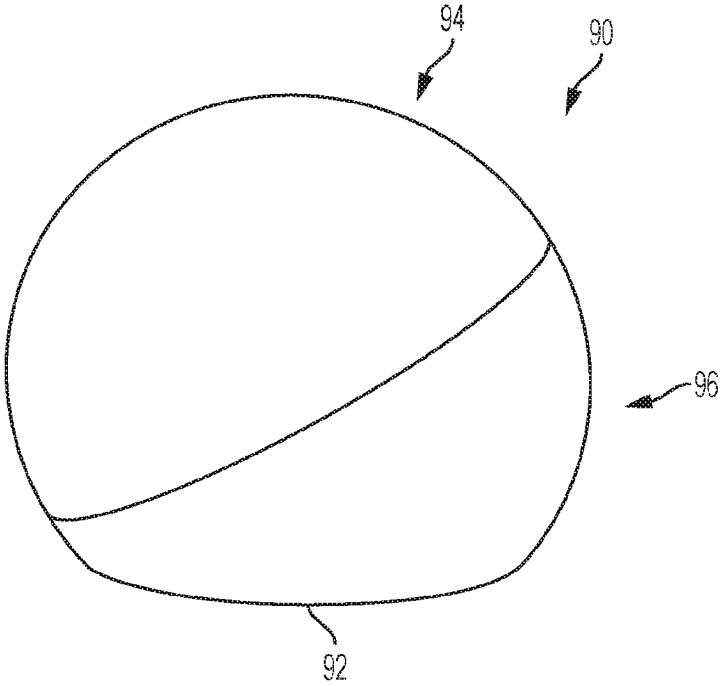
FIG. 11 illustrates the cartridge servicing case of FIG. 10 in a locked configuration.

Referring to FIGS. 10 and 11, another embodiment of a cartridge servicing case 90 is somewhat spherical in shape having a relatively flat bottom support surface 92 for supporting the cartridge servicing case 90 in an upright, standing position, as shown by FIG. 11. The cartridge servicing case 90 includes a moveable cartridge servicing member 94 that can move relative to a case body 96. In this example, the moveable cartridge servicing member 94 rotates between an unlocked open configuration (FIG. 10) and a locked clean configuration (FIG. 11) to wipe and cap nozzles of fluid jet cartridge 16 using wiping and capping elements like those described above with reference to FIGS. 2 and 3. A threaded connection 98 may be provided to lock the moveable cartridge servicing member 94 to the case body 96 and to cause rotation of the moveable cartridge servicing member 94 relative to the case body 96.

Figure 12:
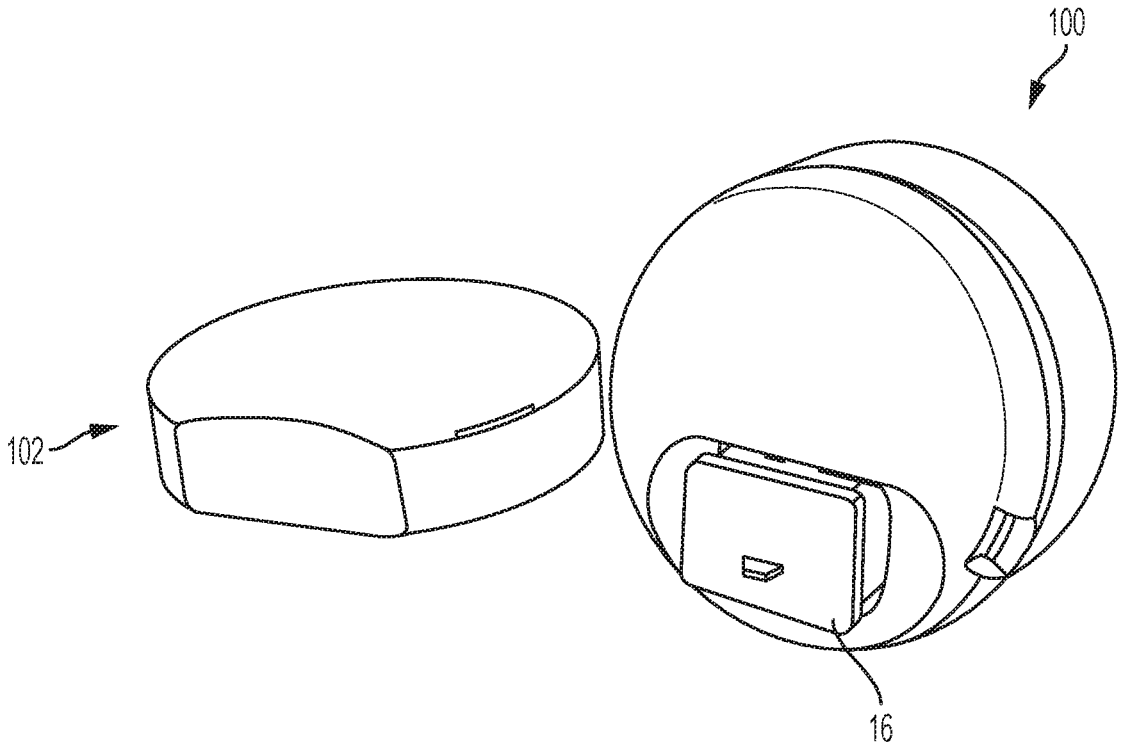
FIG. 12 illustrates a perspective view of another cartridge servicing case in an unlocked configuration according to one or more embodiments described herein.
Figure 13:
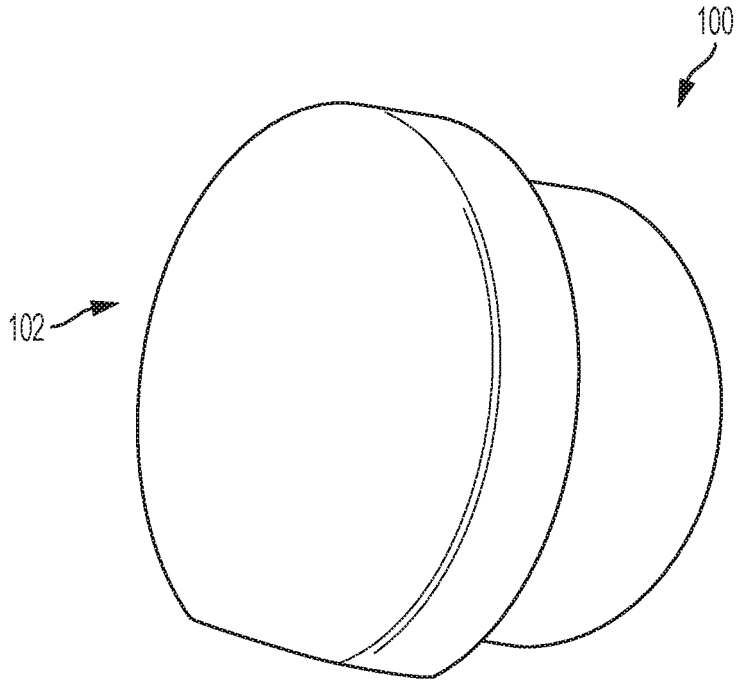
FIG. 13 illustrates the cartridge servicing case of FIG. 12 in a locked configuration.

FIGS. 12 and 13 illustrate a similar embodiment of a cartridge servicing case 100 that is jar shaped including a moveable cartridge servicing member 102 that rotates between an unlocked open configuration (FIG. 12) and a locked clean configuration (FIG. 13) to wipe and cap nozzles of fluid jet cartridge 16 using wiping and capping elements like those described above with reference to FIGS. 2 and 3.

Figure 14:
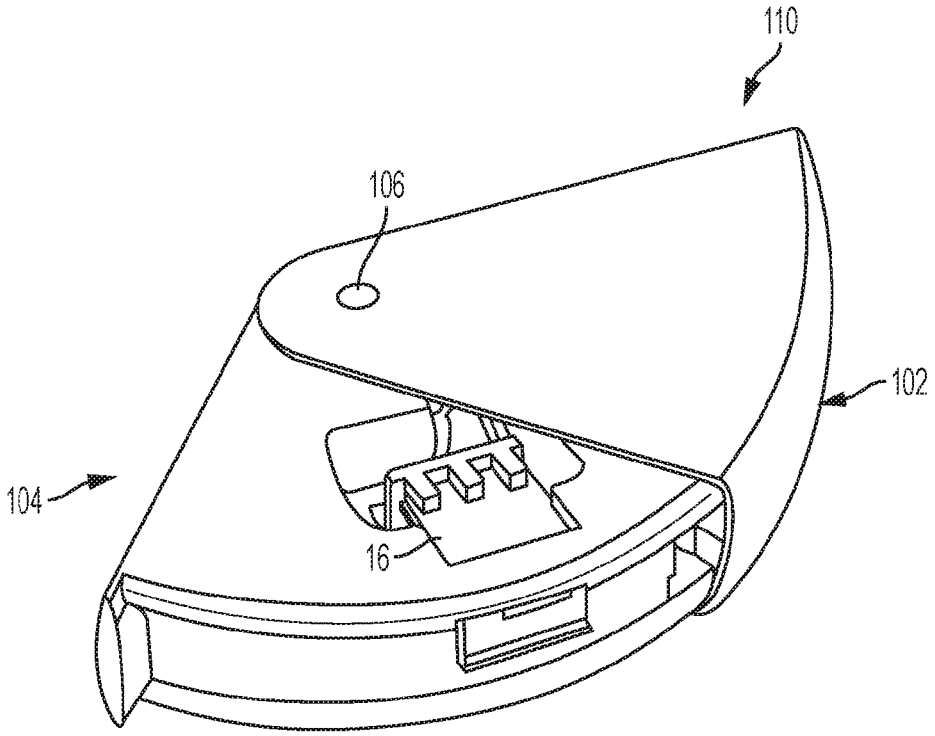
FIG. 14 illustrates a top, perspective view of another cartridge servicing case in an unlocked configuration according to one or more embodiments described herein.
Figure 15:
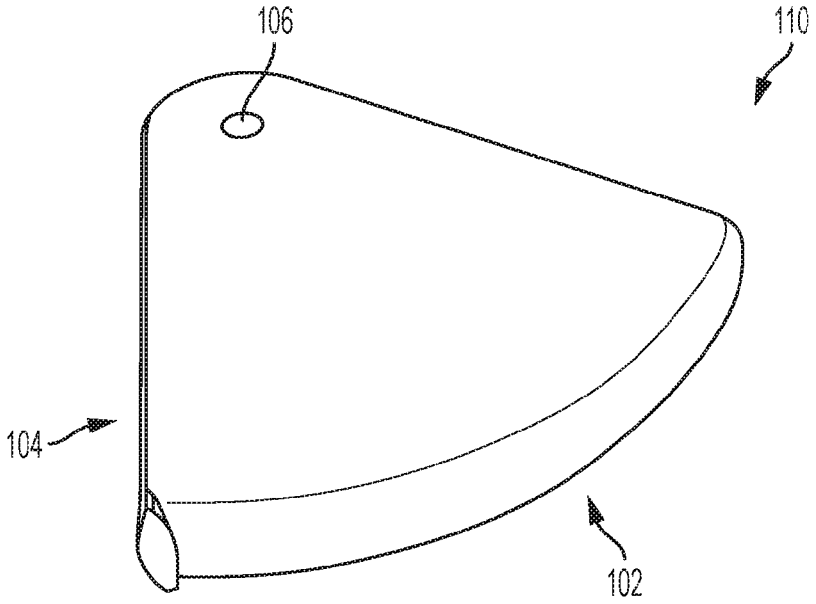
FIG. 15 illustrates the cartridge servicing case of FIG. 14 in a locked configuration.

FIGS. 14 and 15 illustrate another embodiment of a cartridge servicing case 110 that is wedge shaped including a moveable cartridge servicing member 102 that rotates between an unlocked open configuration (FIG. 14) and a locked clean configuration (FIG. 15) to wipe and cap nozzles of fluid jet cartridge 16 using wiping and capping elements like those described above with reference to FIGS. 2 and 3. In this embodiment, the moveable cartridge servicing member 102 rotates relative to a case body 104 via a pivot location 106.

Figure 16:
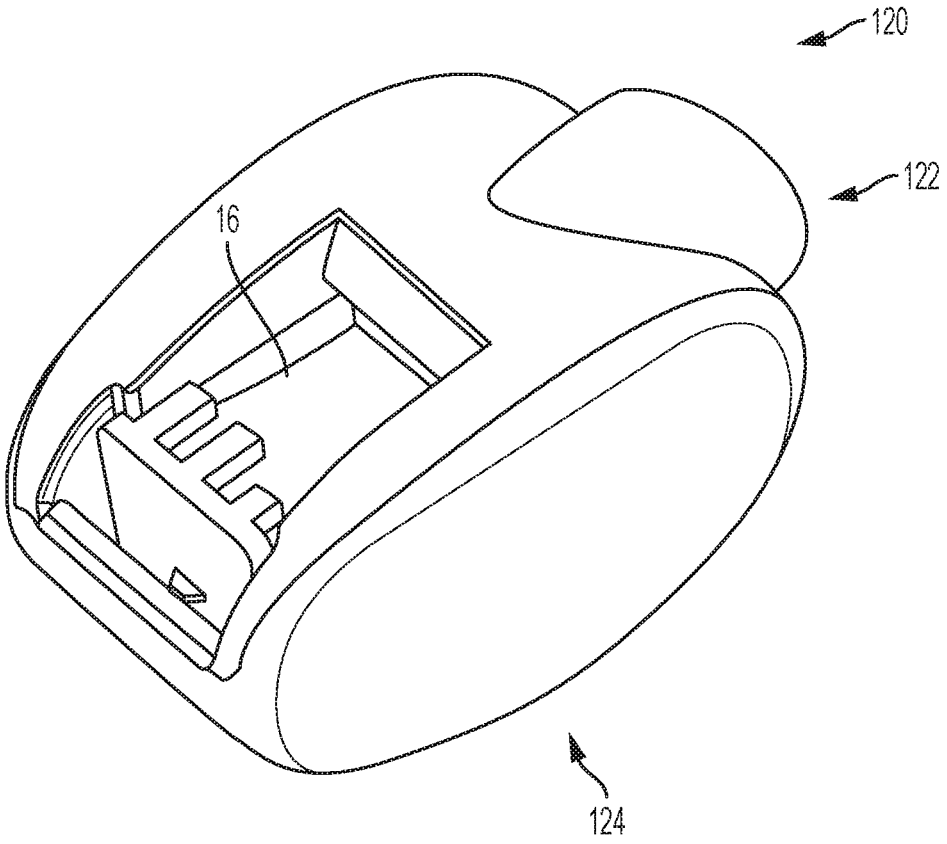
FIG. 16 illustrates a top, perspective view of another cartridge servicing case in an unlocked configuration according to one or more embodiments described herein.

FIG. 16 illustrates another embodiment of a cartridge servicing case 120 including a moveable cartridge servicing member 122 in the form of a plunger that moves between an unlocked open configuration and a locked clean configuration relative to a case body 124 to wipe and cap nozzles of fluid jet cartridge 16 using wiping and capping elements like those described above with reference to FIG. 2.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiments disclosed, or in any combination with any other reference or references, teaches, suggests or discloses any such embodiments. Further, to the extent that any meaning or definition of a term in this document conflicts with any meaning or definition of the same term in a document incorporated by reference, the meaning or definition assigned to that term in this document shall govern.

While particular embodiments have been illustrated and described, it would be obvious to those skilled in the art that various other changes and modifications can be made without departing from the spirit and scope of the claims. It is therefore intended to cover in the appended claims all such changes and modifications that are within the scope of this specification.

What is claimed is:

1. A handheld printing system comprising a handheld printer, and a cartridge servicing case for servicing a fluid jet cartridge carrying a composition, the cartridge servicing case comprising:

a case body having a pocket that is sized to receive the fluid jet cartridge after the fluid jet cartridge is physically removed from the handheld printer and placed into the pocket; and a moveable cartridge servicing member that is moveable relative to the case body, the moveable cartridge servicing member comprising at least one of a wiping element and a capping element carried by the moveable cartridge servicing member;

wherein the pocket is arranged and configured to expose nozzles of the fluid jet cartridge received by the pocket to the moveable cartridge servicing member for a servicing operation using the at least one of the wiping element and capping element.

2. The handheld printing system of claim 1, wherein the moveable cartridge servicing member is moveably connected to the case body.

3. The handheld printing system of claim 2, wherein the moveable cartridge servicing member has an open configuration that allows for positioning of the cartridge in the pocket and a closed configuration that prevents removal of the cartridge from the pocket.

4. The handheld printing system of claim 3, wherein the at least one of the wiping element and capping element are located on the moveable cartridge servicing member such that moving the moveable cartridge servicing member from the open configuration to the closed configuration initiates the servicing operation on the nozzles of the cartridge using the at least one of the wiping element and capping element.

5. The handheld printing system of claim 1, wherein the moveable cartridge servicing member comprises both the wiping element and the capping element.

6. The handheld printing system of claim 5, wherein the wiping element and the capping element are located on the moveable cartridge servicing member such that moving the moveable cartridge servicing member from an open configuration to a closed configuration initiates the servicing operation on the nozzles of the cartridge using the at least one of the wiping element and capping element, where the open configuration allows for positioning of the fluid jet cartridge in the pocket and the closed configuration prevents removal of the fluid jet cartridge from the pocket.

7. The handheld printing system of claim 6, where the capping element comprises a cap that caps the nozzles of the cartridge with the moveable cartridge servicing member in the closed configuration.

8. A handheld printing system comprising a handheld printer, and a cartridge servicing case for servicing a fluid jet cartridge carrying a composition, the cartridge servicing case comprising:

a case body having a pocket that is sized to receive the fluid jet cartridge after the fluid jet cartridge is physically removed from the handheld printer and placed into the pocket; and a moveable cartridge servicing member that is moveable relative to the case body, the moveable cartridge servicing member comprising at least one of a wiping element and a capping element carried by the moveable cartridge servicing member;

wherein the moveable cartridge servicing member has an open configuration that allows for positioning of the fluid jet cartridge in the pocket to expose nozzles of the fluid jet cartridge to the moveable cartridge servicing member and a closed configuration that prevents removal of the fluid jet cartridge from the pocket.

9. The handheld printing system of claim 8, wherein the moveable cartridge servicing member is moveably connected to the case body.

10. The handheld printing system of claim 8, wherein the at least one of the wiping element and capping element are located on the moveable cartridge servicing member such that moving the moveable cartridge servicing member from the open configuration to the closed configuration initiates a servicing operation on the nozzles of the fluid jet cartridge using the at least one of the wiping element and capping element.

11. The handheld printing system of claim 8, wherein the moveable cartridge servicing member comprises both the wiping element and the capping element.

12. The handheld printing system of claim 11, wherein the wiping element and the capping element are located on the moveable cartridge servicing member such that moving the moveable cartridge servicing member from an open configuration to a closed configuration initiates a servicing operation on the nozzles of the fluid jet cartridge using the at least one of the wiping element and capping element, where the open configuration allows for positioning of the fluid jet cartridge in the pocket and the closed configuration prevents removal of the fluid jet cartridge from the pocket.

13. The handheld printing system of claim 12, where the capping element comprises a cap that caps the nozzles of the cartridge with the moveable cartridge servicing member in the closed configuration.

14. A method of servicing a fluid jet cartridge carrying a composition using a cartridge servicing case, the method comprising:

removing the fluid jet cartridge from a handheld printer;

placing the fluid jet cartridge in a pocket of a case body of the cartridge servicing case that is sized to receive the fluid jet cartridge and is physically separate from the handheld printer;

moving a moveable cartridge servicing member from an open configuration to a closed configuration; and wiping nozzles of the fluid jet cartridge exposed to the moveable cartridge servicing member with a wiping element carried by the moveable cartridge servicing member as the moveable cartridge servicing member moves from the open configuration to the closed configuration.

15. The method of claim 14 comprising preventing removal of the fluid jet cartridge from the pocket with the moveable cartridge servicing member in the closed configuration.

16. The method of claim 14 further comprising capping the nozzles with a capping element carried by the moveable cartridge servicing member with the moveable cartridge servicing member in the closed configuration.

17. The method of claim 14, wherein the step of moving the moveable cartridge servicing member is performed manually.

18. The method of claim 14, wherein the moveable cartridge servicing member is movably connected to the case body.

19. The method of claim 14, wherein the step of moving the moveable cartridge servicing member comprises rotating the moveable cartridge servicing member relative to the case body.

20. The method of claim 14, wherein the step of moving the moveable cartridge servicing member comprises translating the moveable cartridge servicing member relative to the case body.

* * * * *